US006427366B2

(12) United States Patent
Horn et al.

(10) Patent No.: US 6,427,366 B2
(45) Date of Patent: Aug. 6, 2002

(54) PHYSICAL-CHEMICAL SCALE REDUCING DEVICE WITH FLAKE DISINTEGRATING GRID FOR A PRESSING IRON

(75) Inventors: Herbert Horn, Erbach (DE); Edgar Hipp, Limonest (FR)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 09/816,659

(22) Filed: Mar. 26, 2001

(30) Foreign Application Priority Data

Mar. 27, 2000 (DE) ..... 100 14 815

(51) Int. Cl.[7] ..... D06F 75/18
(52) U.S. Cl. ..... 38/77.83
(58) Field of Search ..... 38/77.8, 77.82, 38/77.83; 210/94

(56) References Cited

U.S. PATENT DOCUMENTS 2,295,341 A * 9/1942 Finlayson ..... 38/77.81
3,407,522 A * 10/1968 Jepson et al. ..... 38/77.83
5,507,108 A * 4/1996 Bruggink et al. ..... 38/77.8
6,163,990 A * 12/2000 Urata et al. ..... 38/77.8

FOREIGN PATENT DOCUMENTS

| | | | | |
|---|---|---|---|---|
| CH | 614 253 | | 11/1979 | |
| DE | 30 33 964 | | 4/1982 | |
| DE | 44 40 244 | | 5/1996 | |
| EP | 0 610 997 | | 8/1994 | |
| EP | 610997 | * | 8/1994 | ..... 38/77.83 |
| FR | 2 696 197 | | 4/1994 | |
| FR | 2 757 364 | | 6/1998 | |
| JP | 2172500 | * | 7/1990 | ..... 38/77.83 |
| WO | 98 28485 | | 7/1998 | |

* cited by examiner

*Primary Examiner*—Ismael Izaguirre
(74) *Attorney, Agent, or Firm*—Browdy and Neimark

(57) ABSTRACT

A steam iron composed of: a metal heating body containing a chamber that has a steam generating zone; a water flow path in communication with the chamber, the water flow path including a compartment containing a quantity of a scale reducing agent that is contacted by water flowing along the path before the water reaches the chamber; and a screen made of a metal different from that of the heating body and disposed in proximity to the steam generating zone at a location to be traversed by steam generated in the steam generating zone.

14 Claims, 2 Drawing Sheets

PHYSICAL-CHEMICAL SCALE REDUCING DEVICE WITH FLAKE DISINTEGRATING GRID FOR A PRESSING IRON

BACKGROUND OF THE INVENTION

The present invention relates to steam irons in which steam is produced in a quasi-instantaneous manner. These appliances have a useful life that is limited by the build up of scale in the steam chamber.

Numerous devices for reducing the occurrence of scale in an iron have been proposed. One of the most successful physical-chemical systems diffuses a phosphorated product into water before the water is vaporized in order to impede crystallization of the scale in a hard form and to permit its removal by the steam flow. French patent FR 2 757 364 describes an embodiment of such a device where the diffusion of sodium hexametaphosphate (SHMP), which is highly soluble, is controlled by a silicone matrix placed in the water circuit. However, it has been noted that the scale that is formed tends to partially agglomerate under the action of the steam and detaches in the form of flakes that are friable but that are evacuated in bunches that stain the fabric being ironed.

The particles can be retained in the steam chamber by a metal screen as suggested in the German patent DE 3006783 or the Japanese patent 60160999. A screening can equally be produced in a manner disclosed in the French patent FR 2 696 197 where a grid intended to improve the vaporization has its edges raised in the form of bowl. However, the utilization of a screening grid alone eventually provokes blockages of the steam chamber by very hard scale, which cannot be evacuated.

BRIEF SUMMARY OF THE INVENTION

The present invention has as an object a scale reducing device that will prolong the useful life of a steam iron while permitting regular evacuation of scale in a powder form powder that is invisible to the user and will not stain articles being ironed, while preventing obstruction of the chamber as well as of the steam vaporization channels, including the steam delivery holes in the iron soleplate.

The above and other objects are achieved, according to the invention, by a steam iron composed of: a metal heating body containing a chamber that has a steam generating zone; means defining a water flow path in communication with the chamber, the water flow path including a compartment containing a quantity of a scale reducing agent that is contacted by water flowing along the path before the water reaches the chamber, the scale reducing agent being obtained by cross-linking or hardening a silicone elastomer of an organosilicic system that is permeable to water vapor and having an active hydrophilic material and a polyorganosiloxane composition; and a screen made of a metal different from that of the heating body and disposed in proximity to the steam generating zone at a location to be traversed by steam generated in the steam generating zone.

The scale reducing agent could be fabricated in the manner disclosed in French patent FR 2 757 364.

Preferably, the active hydrophilic material is selected from among the metaphosphates of sodium or of potassium. It has been found that in the case of steam irons according to the present invention, no visible flakes exit through the steam delivery holes of the soleplate even when the screen has holes with a hydraulic diameter of the order of two millimeters. Surprisingly, scale does not accumulate in the steam chamber, or in the steam flow channels.

Preferably, the screen is fitted, or gripped, or clamped, tightly between two walls of the steam chamber of the pressing iron.

The process that permits the scale to be present in the form of a very fine powder that is not visible at the outlet of the iron is not clearly understood. Possibly, the friable flakes that detach from the steam generating zone are retained and rub against the screen, which breaks them into the very fine particles. Possibly, the scale that is deposited on or against the screen is broken up by thermal expansion and contraction of the screen. It is also possible that there is an unknown phenomenon resulting from the difference in electrical potential caused by the different characteristics of the metal making up the heating body and the different metal of the screen. This difference in electric potential could have an effect due to the good electric connection resulting from the tight gripping of the screen in the heating body.

Preferably, the screen is coated with a gold layer. This layer protects the screen and prevents it from rusting or corroding. It is also noted that the gold gives rise to a large electric potential difference with a heating body made of aluminum. According to another possibility, the screen can be made of stainless steal.

In either case, the screen is protected from oxidation phenomena and the appearance of a potential difference with a heating body of aluminum is promoted.

Also preferably, the screen is made of an expanded metal that is better able to break up the scale which comes to deposited on or against the screen.

Preferably, the scale reducing agent is contained in a tube and librates its active ingredients through at least one open end of the tube.

The silicone can be in form of matrix molded into the tube without requiring another mold. The active material is librated with a kinetic of the order of unity. This means that the active material is librated at a substantially rate, at least when the temperature of the matrix remains substantially constant. The active material is librated through a progressive front of cracks in the matrix, which coincides with the cross section of the tube so that the liberation of active material is thus perfectly controlled.

Preferably, the tube containing the scale reducing agent is placed in the water reservoir of the iron. The scale reducing agent can be present in a quantity sufficient to assure a good functioning of the system during the entire expected useful life of the iron, or can be renewable. Placement in the water reservoir is simplified when the matrix is molded within the tube.

DETAILED DESCRIPTION OF THE INVENTION

Figure 1:
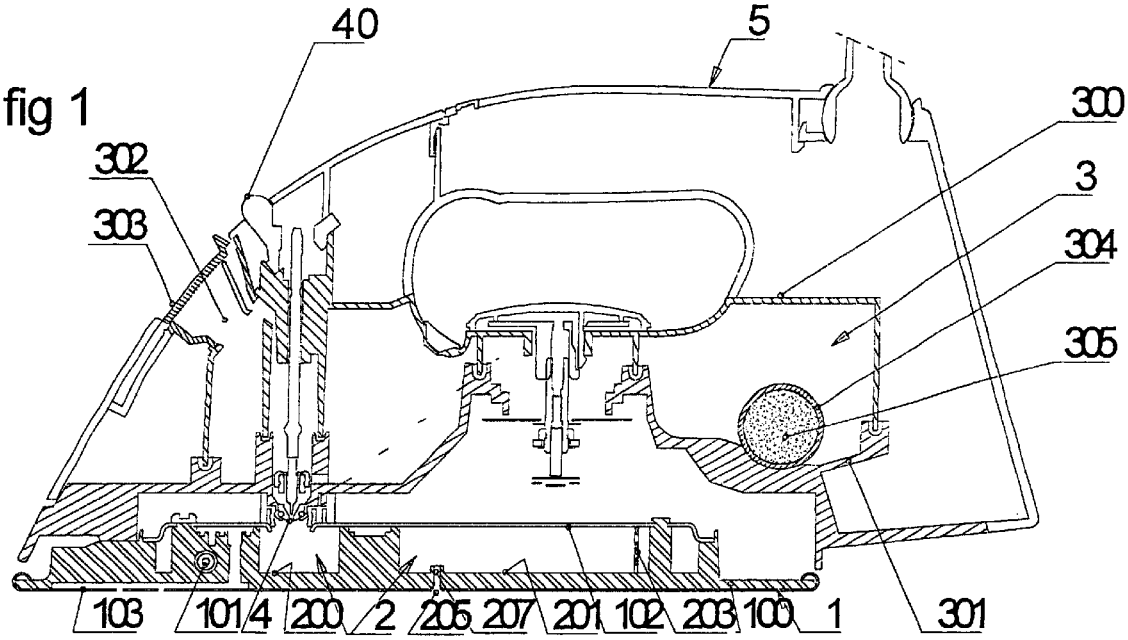
FIG. 1 is a simplified side cross-sectional view, along line I—I of FIG. 2, of a pressing iron constructed according to the present invention.
Figure 2:
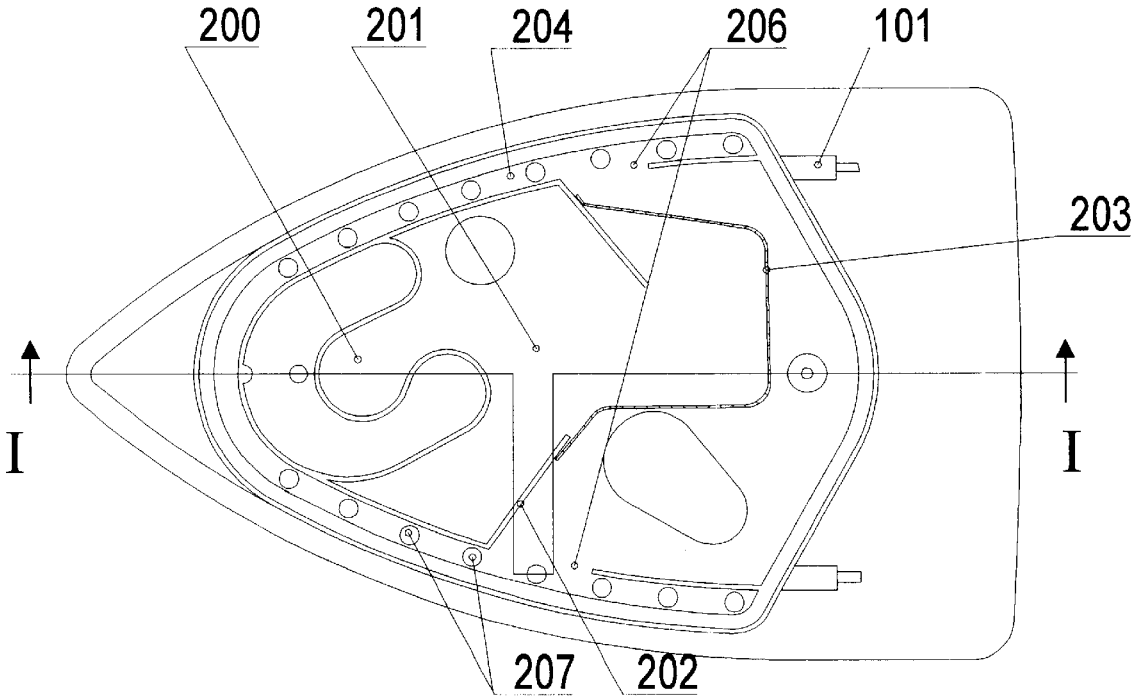
FIG. 2 is a plan view of the soleplate of the iron shown in FIG. 1.

A preferred embodiment of a steam pressing iron according to the invention is shown in FIGS. 1 and 2. This iron is composed of a soleplate 1 having a steam generating chamber 2, a water reservoir 3, a droplet delivery system 4 permitting water to be supplied at a desired rate to chamber 2 from reservoir 3, and a housing, or casing, 5 that includes a handle for grasping the iron.

Reservoir 3 is formed by two pieces 300 and 301 and has a filling opening 302 that can be closed by a sliding cover 303. A tubular element 304 having a constant cross-section perpendicular to the plane of FIG. 1 is disposed at the interior of reservoir 3. Element 304 is filled with a molded silicone elastomer matrix 305 containing SHMP in the form of a solid dispersion. One or both ends of element 304, which ends are parallel to the plane of FIG. 1, are open to expose matrix 305 to water within reservoir 3. Element 304 is installed to be in contact with water in reservoir 3.

Soleplate 1 contains a heating body 100 made of aluminum and defining the walls of steam generating chamber 2. Soleplate 1 further has a tubular resistive heating element 101, a closing plate 102 and a cap, or liner, 103 that is in thermal communication with heating body 100. Closing plate 102 constitutes the upper wall, or cover, of chamber 2. Liner 103 constitutes the external ironing surface of the iron and is intended to be in contact with articles that are being ironed.

Chamber 2 has a zone 200, shown most clearly in FIG. 2, into which water drops are delivered from system 4. Zone 200, in which steam is produced, is extended across soleplate 1 by a second zone 201 that is closed by ribs 202 and a screen 203. Screen 203 is an element preferably made of an expanded metal, such as stainless steel, optionally plated with a thin layer of gold. Screen 203 is tightly clamped between closing plate 102 and the bottom of chamber 2 in order to assure an excellent electric contact between plate 102, screen 203 and heating body 100. An electric potential difference is established between screen 203 and heating body 100 as a consequence of the different characteristics of the two different metals employed for screen 203 and heating body 100.

Screen 203 is formed to have a mesh width between 0.3 and 3 millimeters and is made up of wires preferably having a polygonal cross-section, which may for example be triangular, square, or rectangular. Screen 203 is made of a metal material different from that of heating body 100 and/or plate 102, and may for example be made of stainless steel, optionally covered with a gold layer having a thickness between 10 $\mu$m and 100 m$\mu$.

Advantageously, the bottom of chamber 2 is covered with an anti-calefaction coating, i.e. a coating that prevents water droplets dropped onto a hot plate from remaining in liquid form. The steam produced in chamber 2 can escape through passages 206, channels 204 and holes 207 toward steam delivery openings 205 that are provide in liner 103 for delivery to an article being pressed, either directly or via other distribution channels located the soleplate. The steam delivery passages and channels and the steam outlet openings in liner 103 can be formed according to principles that are well known in the art.

When the pressing iron is at room temperature, only very little SHMP is librated from silicone matrix 305, even if matrix 305 is wetted. When the iron is to be used, the user fills water reservoir 3 via opening 302 and then moves cover 303 into the closed position shown in FIG. 1. When the iron is heated, the temperature in the reservoir is first raised to a moderate level that is sufficient to strongly accelerate diffusion of SHMP into the water, and vapor diffusing toward the SHMP grains, which are very hydrophilic, causes the grains to be charged with water and to swell, thereby breaking the silicone network. The SHMP diffusion front progresses slowly into the matrix along the axis of tubular element 304, i.e. perpendicular to the plane of FIG. 1, the cross-section of element 304 being constant in this direction, and the diffusion of SHMP is thus well controlled.

Preferably, the length and cross-section of tubular element 304 are selected to assure a continued diffusion of the scale-preventing product for the useful life of the iron. In another form of construction, tubular element 304 and its silicone matrix 305 are replaceable.

During ironing, the user can activate a control element 40 to operate system 4, leading to the production of steam that will be used in the ironing process. When control element, or button, 40 is depressed, water containing dissolved SHMP is allowed to flow in the form of drops from reservoir 3 into chamber 2, where the drops fall into zone 200. The water spreads out to a greater or lesser extent across chamber 2, the extent depending on the flow rate, and reaches zone 201. Vaporization of the water produces steam which flows toward the article being ironed while passing through screen 203 and then into passages 206 and channels such as 204 and holes 207 in order to reach delivery of openings 205 of the soleplate.

Any scale left by the vaporization of the water is in large measure in powder form due the action of the SHMP and is evacuated by being at least in part entrained by the steam.

Another part of the scale left by the water attaches to the wall of chamber 2 in the form of a crumbly, or friable, layer, which scale material subsequently detaches in the form of flakes that are then retained by screen 203. A further part of the scale comes to be deposited as a crust directly on screen 203. Surprisingly, the flakes and the crust of scale disintegrate at the level of the screen into a fine powder that is invisible to the naked eye, this powder then being evacuated out of the iron through the steam delivery openings. It is thought that the electric potential differential present at the level of screen 203, of the order 2–3 volts, provokes a transformation of the cohesion of the scale crystals, this transformation possibly being completed by the polygonal geometry of the cross-section of the wires of the screen. Screen 203 then is able to prevent the passage of large particles and retains them so that they can be transformed into fine powder. According to other embodiments of the invention, the SHMP can be replaced another hydrophilic phosphorous product.

As a result, the scale is evacuated regularly in an invisible form and without inconveniencing the user. The useful life of the iron is increased by the hydrophilic scale-preventing product while, at the same time, this product does not create any inconveniences, such as the appearance of stains on the articles being ironed.

This application relates to subject matter disclosed in German Application No. DE-100 14 815.8, filed Mar. 27, 2000, the entirety of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention. Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A steam iron comprising:

a metal heating body including a soleplate having steam delivery openings and containing a chamber that has a steam generating zone;

means defining a water flow path in communication with said chamber, said water flow path including a compartment containing a quantity of a scale reducing agent that is contacted by water flowing along the path before the water reaches said chamber;

means defining a steam flow path between said steam generating zone and said steam delivery openings; and a screen made of a metal different from that of said heating body and disposed in said steam flow path in proximity to said steam generating zone at a location to be traversed by steam generated in said steam generating zone, said screen being operative to prevent passage of scale in the form of visible flakes from said steam generating zone to said steam delivery openings.

2. Iron according to claim 1 wherein said screen is tightly gripped between two walls of said chamber.

3. Iron according to claim 1 wherein said screen is coated with a layer of gold.

4. Iron according to claim 1 wherein said screen is made of stainless steel.

5. Iron according to claim 1 wherein said screen is an expanded metal.

6. Iron according to claim 1 wherein said scale reducing agent contains an active hydrophilic material and further comprising a tube containing said scale reducing agent and having at least one end through which the active hydrophilic material is dispensed.

7. Iron according to claim 6 wherein said water flow path includes a reservoir and said tube is disposed in said reservoir.

8. Iron according to claim 1 wherein said screen is made of stainless steel coated with a layer of gold.

9. Iron according to claim 8 wherein said screen is an expanded metal.

10. Iron according to claim 1 wherein said screen and said heating body are in contact with one another and the different metals of said screen and said heating body cause an electric potential difference to be present between said screen and said heating body.

11. Iron according to claim 1 wherein said screen is configured to convert scale appearing in the form of visible flakes in said steam generating zone into an invisible powder that can be evacuated through said steam delivery openings.

12. A steam iron comprising:

a metal heating body containing a chamber that has a steam generating zone;

means defining a water flow path in communication with said chamber, said water flow path including a compartment containing a quantity of a scale reducing agent that is contacted by water flowing along the path before the water reaches said chamber, said scale reducing agent being obtained by cross-linking or hardening a silicone elastomer of an organosilicic system that is permeable to water vapor and having an active hydrophilic material and a polyorganosiloxane composition; and a screen made of a metal different from that of said heating body and disposed in proximity to said steam generating zone at a location to be traversed by steam generated in said steam generating zone, said screen being tightly gripped between two walls of said chamber.

13. Iron according to claim 11 wherein the active hydrophilic material is selected from among the metaphosphates of sodium or potassium.

14. A steam iron comprising:

a metal heating body containing a chamber that has a steam generating zone;

means defining a water flow path in communication with said chamber, said water flow path including a compartment containing a quantity of a scale reducing agent that is contacted by water flowing along the path before the water reaches said chamber, said scale reducing agent being obtained by cross-linking or hardening a silicone elastomer of an organosilicic system that is permeable to water vapor and having an active hydrophilic material and a polyorganosiloxane composition; and a screen made of a metal different from that of said heating body and disposed in proximity to said steam generating zone at a location to be traversed by steam generated in said steam generating zone, wherein said screen and said heating body are in contact with one another and the different metals of said screen and said heating body cause an electric potential difference to be present between said screen and said heating body.

* * * * *